US008608461B2

(12) United States Patent
Cooke

(10) Patent No.: US 8,608,461 B2
(45) Date of Patent: Dec. 17, 2013

(54) FLUID PUMP

(75) Inventor: Michael Peter Cooke, Gillingham (GB)

(73) Assignee: Delphi Technologies Holding S.arl, Luxembourg (LU)

( * ) Notice: Subject to any disclaimer, the term of this patent is extended or adjusted under 35 U.S.C. 154(b) by 308 days.

(21) Appl. No.: 12/612,712

(22) Filed: Nov. 5, 2009

(65) Prior Publication Data

US 2010/0129241 A1 May 27, 2010

(30) Foreign Application Priority Data

Nov. 24, 2008 (EP) ..... 08169806

(51) Int. Cl.
*F04B 17/04* (2006.01)

(52) U.S. Cl.
USPC ..... 417/417; 417/366

(58) Field of Classification Search
USPC ..... 417/417, 366
See application file for complete search history.

(56) References Cited

U.S. PATENT DOCUMENTS

| | | | | |
|---|---|---|---|---|
| 3,250,219 | A | 5/1966 | McCarty et al. | |
| 4,310,420 | A | 1/1982 | Konishi | |
| 4,376,449 | A * | 3/1983 | Nelson et al. | 137/391 |
| 5,509,792 | A | 4/1996 | Sullivan et al. | |
| 5,647,737 | A * | 7/1997 | Gardner et al. | 417/454 |
| 6,558,141 | B2 * | 5/2003 | Vonalt et al. | 417/554 |
| 2004/0022651 | A1 * | 2/2004 | Hashimoto et al. | 417/417 |
| 2005/0061372 | A1 * | 3/2005 | McGrath et al. | 137/539.5 |
| 2005/0175481 | A1 * | 8/2005 | Harbuck | 417/416 |
| 2008/0014103 | A1 * | 1/2008 | Cooke | 417/410.1 |

FOREIGN PATENT DOCUMENTS

| | | | |
|---|---|---|---|
| EP | 1 878 920 | 1/2008 | |
| GB | 1 187 713 | 4/1970 | |
| GB | 1567041 | * 10/1976 | F02M 37/18 |
| GB | 1 567 041 | 5/1980 | |
| JP | 55-122149 | 9/1980 | |
| JP | 62-78372 | 5/1987 | |
| JP | 2-86968 | 3/1990 | |
| JP | 2003-206869 | 7/2003 | |

OTHER PUBLICATIONS

European Search Report dated Apr. 29, 2009.
Japan Office Action dated May 14, 2012.

* cited by examiner

*Primary Examiner* — Peter J Bertheaud
*Assistant Examiner* — Dominick L Plakkoottam
(74) *Attorney, Agent, or Firm* — Thomas N. Twomey

(57) ABSTRACT

A pump for pumping a fluid comprises an inlet, an outlet, an internal volume disposed between the inlet and the outlet, a first pumping arrangement operable to pump a first volume of fluid from the inlet into the internal volume, and a second pumping arrangement operable to pump a second volume of fluid from the internal volume into the outlet. In a first mode of operation of the pump, the first volume of fluid is greater than the second volume of fluid such that, in use, the pressure of the fluid within the internal volume is elevated to a level above the pressure of the fluid at the inlet.

20 Claims, 3 Drawing Sheets

FLUID PUMP

TECHNICAL FIELD

The present invention relates to a pump for pumping a fluid. More particularly, the invention relates to a pump for dosing liquid reagent for the selective catalytic reduction of the oxides of nitrogen in the exhaust gas stream of an internal combustion engine.

BACKGROUND TO THE INVENTION

It is known in the art to dose a reagent, such as urea solution, into the exhaust system of an internal combustion engine in order to enable a selective catalytic reduction (SCR) catalyst to reduce oxides of nitrogen (NOx) in the exhaust gas stream. The dosing of reagent is typically performed using a fluid dosing pump or fluid doser.

An example of a known fluid dosing pump is described in the Applicant's published European Patent No. 1878920. Such a dosing pump is usually mounted to a hot exhaust system and, accordingly, relies on a combination of insulation and the cooling effect provided by the reagent fluid being pumped through it in order to prevent overheating.

The exhaust systems of modern diesel engines are typically fitted with diesel particulate filters (DPF) to remove soot from the exhaust gas stream. A DPF requires periodic "regeneration", which involves raising the temperature of the exhaust gases to a higher than normal temperature in order to burn off the soot trapped in the DPF. Occasionally, an "extreme regeneration" is required, during which the exhaust gases are raised to a temperature even greater than during the normal regeneration process.

During an "extreme regeneration" event, the high exhaust gas temperatures tend to release ammonia stored in the SCR catalyst, which is able to reduce all the oxides of nitrogen present. Accordingly, in such circumstances it is not desirable to dose reagent using the dosing pump because the reagent is not required for SCR and is wasted. However, by reducing or stopping dosing, the dosing pump may be adversely affected due to the extreme exhaust gas temperatures combined with the reduced cooling flow of reagent through the pump. It has been determined from engine testing under such conditions that the fluid inside the main pump body can boil, preventing the pump from dosing correctly.

It is an object of the present invention to provide a fluid dosing pump which substantially overcomes or mitigates the aforementioned problem.

SUMMARY OF INVENTION

According to a first aspect of the invention, a pump for pumping a fluid comprises an inlet means, an outlet means, an internal volume disposed between the inlet means and the outlet means, first pumping means operable to pump a first volume of fluid from the inlet means into the internal volume, and second pumping means operable to pump a second volume of fluid from the internal volume into the outlet means. In a first mode of operation of the pump, the first volume of fluid is greater than the second volume of fluid such that, in use, the pressure of the fluid within the internal volume is elevated to a level above the pressure of the fluid at the inlet means.

The present invention provides a pump in which the internal volume can be primed with fluid rapidly by pumping in a greater volume of fluid from the pump inlet than is pumped out to the pump outlet with each movement of the actuator arrangement. Furthermore, by virtue of the first volume of fluid being greater than the second volume of fluid, the fluid in the main body of the pump is pressurised, so as to increase the boiling point of the fluid within it. Accordingly, such a pump has an improved ability to operate at high temperatures.

The first pumping means may comprise an inlet pumping chamber for receiving fluid from the inlet means, and the second pumping means may comprise an outlet pumping chamber from which fluid is pumped to the outlet means. The inlet pumping chamber and the outlet pumping chamber each define a respective part of the internal volume.

In one embodiment of the invention, the pump comprises an actuator arrangement operable to move between a first position and a second position so as to operate both the first pumping means and the second pumping means.

The actuator may comprise a plunger that forms part of both the first pumping means and the second pumping means.

In one embodiment, the pump comprises a plunger arranged to move in response to operation of the actuator arrangement. The plunger may comprise an upstream end being arranged so as to be reciprocable within the inlet pumping chamber, and a downstream end being arranged so as to reduce the volume of the outlet pumping chamber when the actuator arrangement moves from the first to the second position.

The plunger may comprise an annular plunger seal disposed at the upstream end thereof. Optionally, the plunger seal has an outer diameter which is sized so as to be an interference fit with an adjacent wall of the inlet pumping chamber, in order to prevent fluid communication between a portion of the inlet pumping chamber disposed upstream of the plunger seal and a portion of the inlet pumping chamber disposed downstream of the plunger seal during a pumping stroke of the plunger. Accordingly, the volume of the downstream portion of the inlet pumping chamber is reduced when the actuator arrangement moves from the first to the second position.

In one arrangement, the plunger comprises an enlarged diameter portion at the upstream end thereof which defines a plunger foot, the plunger foot being sized so as to be a clearance fit with an adjacent wall of the inlet pumping chamber, and retaining means attached to the plunger and spaced from the plunger foot in the downstream direction. In this case, the retaining means optionally comprises at least a portion which extends radially from the plunger towards an adjacent wall of the inlet pumping chamber. The plunger seal is optionally disposed between the plunger foot and the retaining means.

The retaining means may be spaced from the plunger foot by an axial distance greater than the axial thickness of the plunger seal, and the plunger seal may have an inner diameter which is sized so as to be a clearance fit with the plunger but which is less than the diameter of the plunger foot and the distance by which the retaining means extends radially towards the adjacent wall of the inlet pumping chamber.

The pump may comprise pressure regulating means for regulating the pressure of the fluid within the internal volume of the pump at a predetermined value. For example, the pressure regulating means may be operable, in a second mode of operation of the pump, to reduce the first volume of fluid pumped from the inlet means when said fluid pressure within the internal volume of the pump exceeds the predetermined value.

The pressure regulating means may be operable between an open and a closed position, the pressure regulating means comprising biasing means for biasing the pressure regulating means into said closed position. Optionally, the pressure regulating means is operable to move into the open position, against the biasing force of the biasing means, when the fluid pressure within the internal volume of the pump exceeds the predetermined value, so as to reduce the first volume of fluid pumped from the inlet means.

In one embodiment, the pressure regulating means comprises a bypass passage for providing fluid communication between an upstream portion of the inlet pumping chamber and a downstream portion of the inlet pumping chamber, so as to reduce the first volume of fluid pumped from the inlet means by the first pumping means. The pressure regulating means may also comprise a closure member arranged so as to prevent the flow of fluid through said bypass passage when the pressure regulating means is in the closed position.

The pump may comprise an inlet valve operable between a closed position and an open position and arranged to prevent the flow of fluid from the inlet means to the internal volume when the inlet valve is in the closed position, and the closure member may comprise the inlet valve. Alternatively, or in addition, the closure member may comprise at least one washer.

The pressure regulating means may further comprise venting means for venting fluid to the inlet means in the event that the fluid pressure in the internal volume exceeds said predetermined value.

The pump may comprise an inlet valve operable between a closed position and an open position and arranged to prevent the flow of fluid from the inlet means to the internal volume when the inlet valve is in the closed position.

In one embodiment of the invention, the pump comprises a delivery valve operable between a closed position and an open position and arranged to restrict the flow of fluid from the internal volume to the outlet means when the delivery valve is in the closed position.

A particular advantage of such a pump is that the need to prime the dosing system is reduced because the pump retains fluid and does not fill with air.

In another aspect of the invention, a pump comprises an inlet means, an outlet means, an internal volume disposed between the inlet means and the outlet means, first pumping means operable to pump a first volume of fluid from the inlet means into the internal volume, and second pumping means operable to pump a second volume of fluid from the internal volume into the outlet means. In a first mode of operation of the pump, the first volume of fluid is greater than the second volume of fluid such that, in use, the pressure of the fluid within the internal volume is elevated to a level above the pressure of the fluid at the inlet means. The pump further comprises an actuator arrangement operable to move between a first position and a second position so as to operate both the first pumping means and the second pumping means.

According to a still further aspect of the present invention, a pump for pumping a fluid comprises an inlet means, an outlet means, and an internal volume disposed between said inlet means and said outlet means. In use, the fluid pressure within the internal volume is elevated to a level above that of the fluid pressure at said inlet mean. The pump further includes means for maintaining the fluid pressure within the internal volume at said elevated level when the pump is not in use.

The fluid may be a liquid reagent for selective catalytic reduction.

The invention also extends to a dosing device comprising a pump according to the first aspect of the invention.

Optional features of the first and further aspects of the invention may be incorporated within such a dosing device, alone or in appropriate combination.

BRIEF DESCRIPTION OF DRAWINGS

Embodiments of the present invention will now be described, by way of example only, with reference to the accompanying drawings, in which.

DETAILED DESCRIPTION OF PREFERRED EMBODIMENTS

Figure 1:
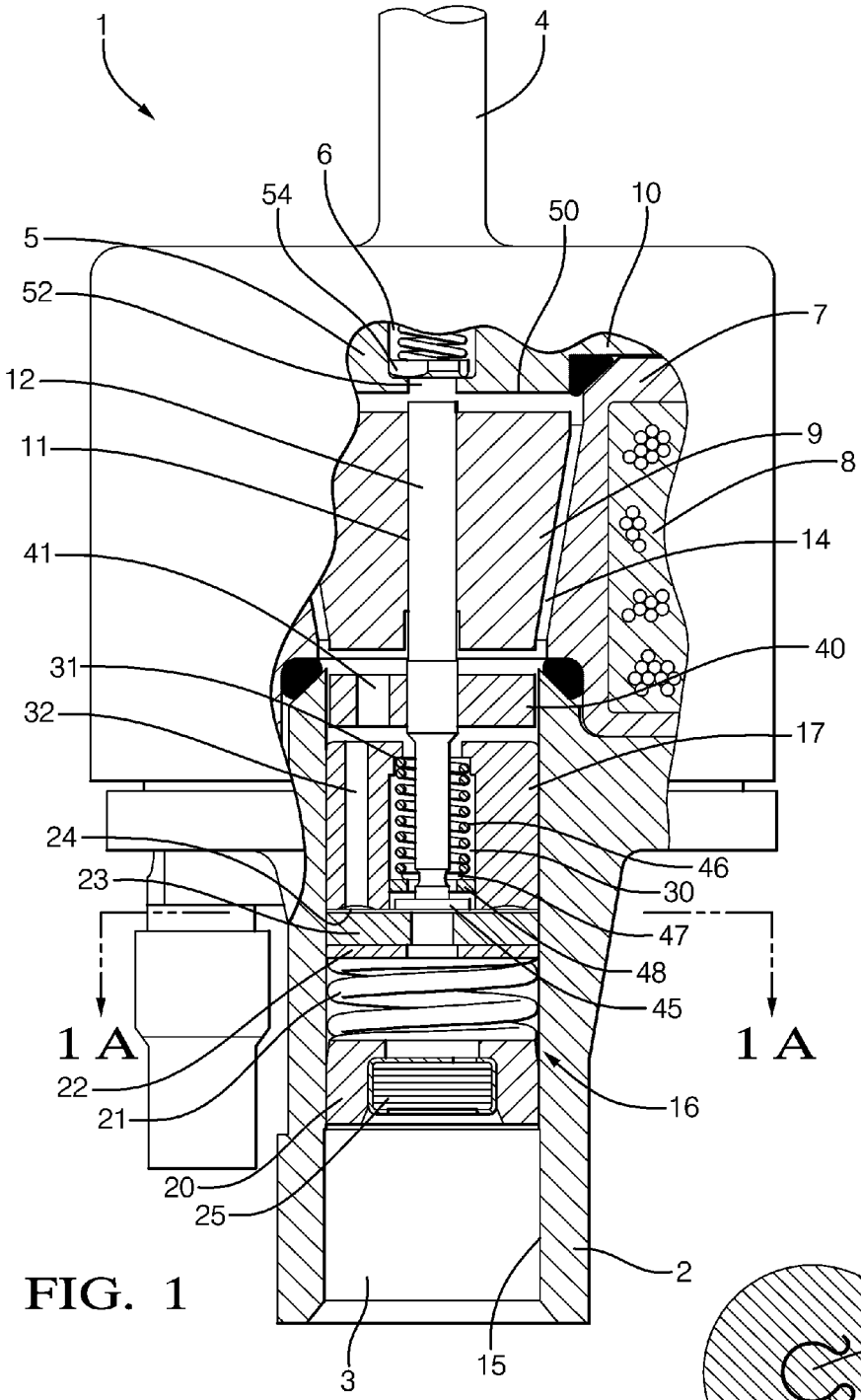
FIG. 1 is a sectional view of an embodiment of a fluid dosing pump according to the present invention.
Figure 1A:
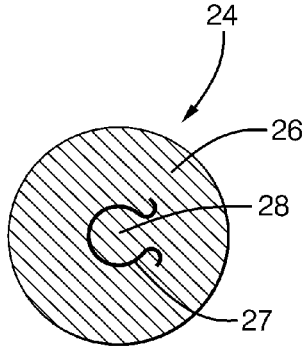
Figure 2:
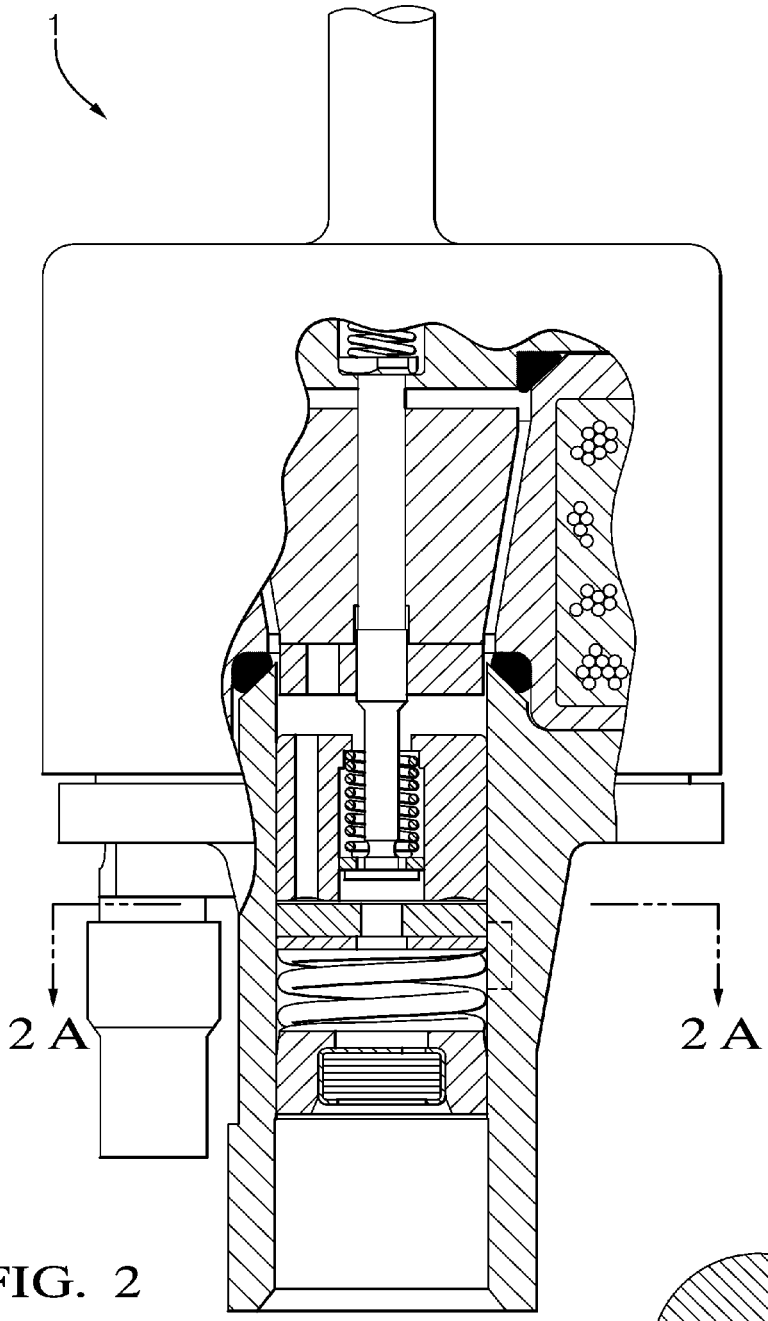
FIG. 2 shows the fluid dosing pump of FIG. 1 during a pumping stroke in a first mode of operation.
Figure 2A:
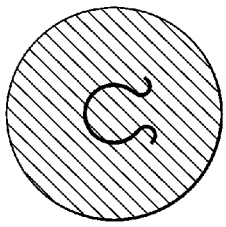
Figure 3:
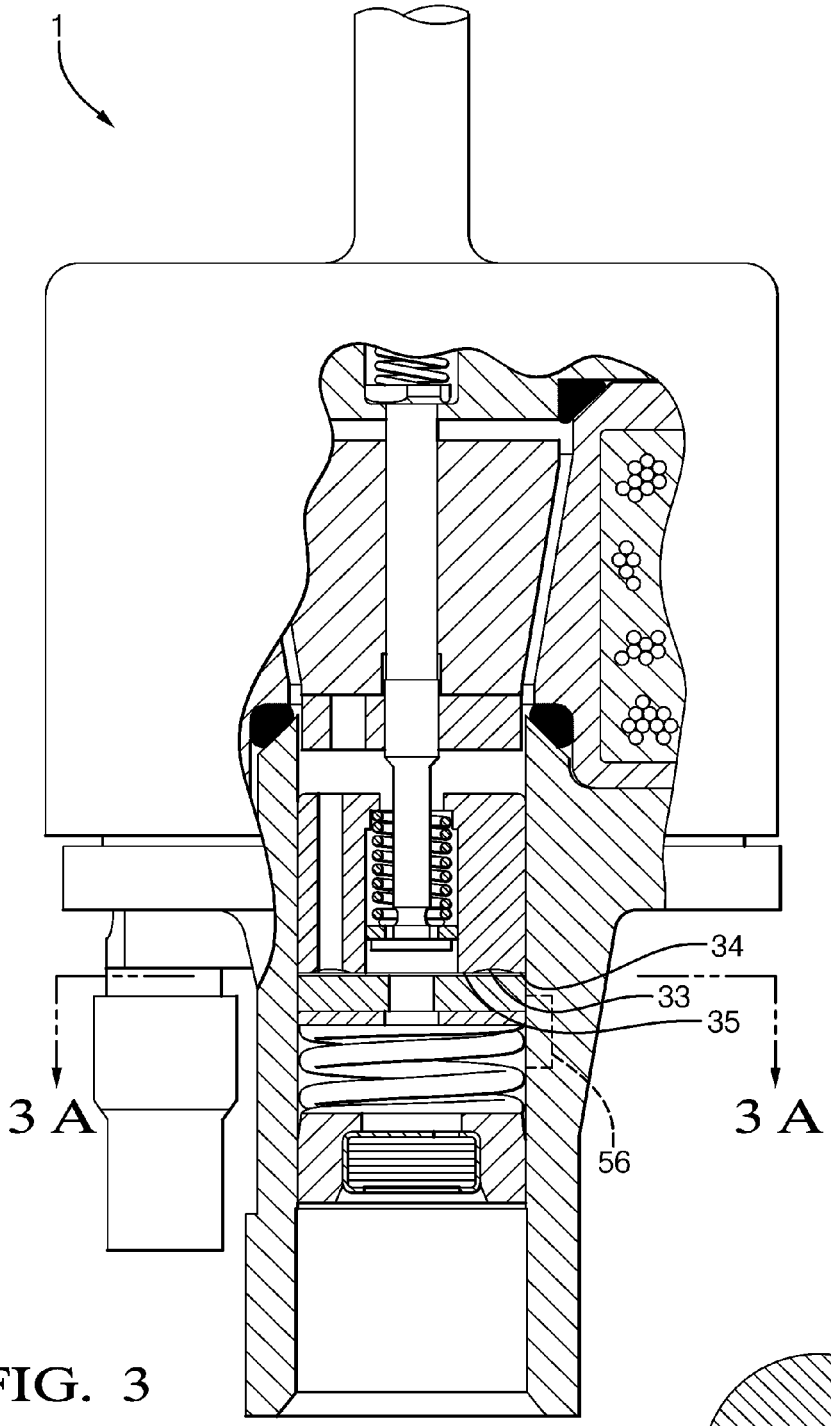
FIG. 3 shows the fluid dosing pump of FIG. 1 during a pumping stroke in a second mode of operation.
Figure 3A:
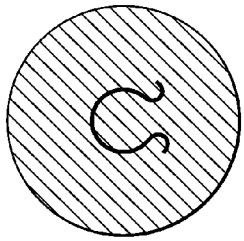

Referring to FIGS. 1 to 3, a dosing pump 1 according to the invention comprises a main housing 2, which defines a pump inlet 3 disposed at an inlet end or upstream end of the dosing pump 1. A connecting pipe 4 disposed at the downstream end of the dosing pump 1 couples a pump outlet 6 of the dosing pump 1 to a dispenser (not shown).

The dispenser is mounted within the flow of exhaust gases in the exhaust system of an internal combustion engine, upstream of an SCR catalyst, and is arranged at such an attitude that its spray cooperates with the exhaust flow to give optimum mixing between exhaust gas and reagent. The dosing pump 1 is disposed outside the exhaust system so that it may benefit from exposure to ambient cooling air.

The dosing pump 1 also includes an actuator arrangement disposed within the main housing 2, between the pump inlet 3 and the pump outlet 6. The actuator arrangement comprises a pole element 5, a coil former 7 and a solenoid coil 8. The pole element 5 comprises a generally cylindrical inner pole piece 9 and an outwardly-directed flange 10. The pole element 5 includes an axial bore 11. A plunger 12 is slidably accommodated within the bore 11. The coil former 7 is disposed around the inner pole piece 9 of the pole element 5, and a supply passage 14 is defined by an annular cavity between the coil former 7 and the inner pole piece 9.

The coil 8 is in electrical communication with a power supply (not shown). The power supply is capable of supplying a variable current to the coil 8 so as to induce a variable magnetic field around the coil 8.

Upstream of the inner pole piece 9, the main housing 2 defines a generally cylindrical cavity 15 which is co-axial with the axial bore 11 of the inner pole piece 9. The upstream end of the cavity 15 defines the pump inlet 3 of the dosing pump 1. The dosing pump 1 also comprises pressure regulating means 16 and a pumping chamber element 17, disposed within the cavity 15, downstream from the pump inlet 3.

The pressure regulating means 16 comprises a pressure regulating spring seat 20, a biasing means comprising a pressure regulating spring 21, a rigid washer 22, a seal washer 23, a one-way valve 24 and a bypass passage 32.

The pressure regulating spring seat 20 comprises a generally cylindrical member provided with an axial bore to permit the flow of liquid reagent therethrough. The pressure regulating spring seat 20 is an interference fit with the wall of the cavity 15. In the embodiment of FIG. 1, a reagent filter 25 is disposed inside the axial bore of the pressure regulating spring seat 20, in order to filter any particulate matter from the liquid reagent supplied to the pump inlet 3.

The downstream-facing surface of the pressure regulating spring seat 20 supports a first end of the pressure regulating spring 21. A second end of the pressure regulating spring 21 supports the rigid washer 22 which, in turn, supports the seal washer 23. The outer diameter of the seal washer 23 is an interference fit with the wall of the cavity 15 and thereby provides a seal to prevent the flow of liquid reagent therebetween. The seal washer 23 may be formed from rubber, such as fluorocarbon rubber or silicone rubber, or polymer, such as PEEK or PTFE.

The one-way valve 24 is disposed on the downstream surface of the seal washer 23. In the present embodiment, the one-way valve 24 is a flap valve and comprises a disc member 26 having a cut line 27 which defines a central flap 28, as shown by the cross-section along the line A-A in FIGS. 1 to 3. The flap 28 is arranged so as to cover the central hole defined by the seal washer 23, when the one-way valve 24 is in its closed position. The one-way valve 24 may be made from stainless steel, polyimide or polyester sheet material.

The one-way inlet valve 24 is operable such that it opens when the pressure difference between upstream and downstream sides of the inlet valve 24 exceeds a threshold value. More specifically, when the fluid pressure on the downstream side of the inlet valve 24 is sufficiently lower than the fluid pressure on the upstream side, the flap 28 lifts, so as to allow fluid to flow through the inlet valve 24. The flap 28 is cut such that it will only open in the downstream direction. Accordingly, in the event that a higher fluid pressure prevails on the downstream side of the inlet valve 24, the flap 28 remains closed and fluid is prevented from flowing through the inlet valve 24 in the upstream direction.

The pumping chamber element 17 comprises a generally cylindrical member provided with an axial through bore which defines an inlet pumping chamber 30. The axial through bore has a reduced diameter portion at the downstream end thereof, which defines a plunger return spring seat 31.

The pumping chamber element 17 is provided with the bypass passage 32, in the form of a drilling, which extends from the upstream side of the pumping chamber element 17 to the downstream side, the bypass passage 32 being spaced apart radially from the inlet pumping chamber 30.

Referring to FIG. 3, an annular groove 33 formed in the upstream surface of the pumping chamber element 17 defines first and second annular seats 34, 35 either side thereof. The radius of the annular groove 33 is substantially equal to the radial displacement of the bypass passage 32. Accordingly, the first annular seat 34 is formed at a radius between the upstream end of the bypass passage 32 and the cavity wall 15, and the second annular seat 35 is formed between the upstream end of the bypass passage 32 and the upstream end of the inlet pumping chamber 30.

A disc-shaped armature 40 is attached to the plunger 12, the armature 40 being arranged so as to be reciprocable within a space defined between the upstream end of the inner pole piece 9 and the downstream end of the pumping chamber element 17. The armature 40 is sized so as to be a clearance fit with the adjacent wall of the cavity 15. The armature 40 also includes a through bore 41, in the form of a drilling, which extends from the upstream side of the armature 40 to the downstream side, the through bore 41 being spaced apart radially from the plunger 12.

The purpose of the through bore 41 is to vent the fluid displaced by the armature 40 as the armature 40 moves back and forth, so as to enable fast movement of the armature 40. In order to provide sufficient vent area and in order to balance the fluid and magnetic forces on the armature 40, a plurality of through bores 41 may be provided in the armature. For example, the armature 40 may include seven such through bores 41, which may be radially spaced at regular intervals around the armature 40.

The upstream end of the plunger 12 extends into the inlet pumping chamber 30 of the pumping chamber element 17 where it terminates in a plunger foot 45. The plunger foot 45 has a diameter larger than the body of the plunger 12 but smaller than that of the inlet pumping chamber 30. Accordingly, an annular gap is defined between the plunger foot 45 and the wall of the inlet pumping chamber 30.

A plunger return spring 46, in the form of a compression coil spring, is disposed around the circumference of the plunger 12 inside the inlet pumping chamber 30. The downstream end of the plunger return spring 46 seats against the plunger return spring seat 31. The upstream end of the plunger return spring 46 is biased against a clip (or retaining means) 47 attached to the plunger 12. The clip 47 may be an 'e' clip, as known to those skilled in the art. The clip 47 is axially spaced from the plunger foot 45.

A plunger seal (or piston seal) 48 is disposed between the clip 47 and the plunger foot 45. The plunger seal 48 is in the form of a washer or ring which is sized such that the outer circumference of the plunger seal 48 is an interference fit with the wall of the inlet pumping chamber 30. The inner diameter of the plunger seal 48 is sized so as to be greater than that of the plunger body 12, but less than that of either the plunger foot 45 or the clip 47. Thus, the plunger seal 48 is retained on the plunger 12 by means of the plunger foot 45 and the clip 47, but with a radial clearance between the inner diameter of the plunger seal 48 and the outer surface of the plunger body 12. Furthermore, the axial spacing between the clip 47 and the plunger foot 45 is greater than the thickness of the plunger seal 48. Accordingly, as shown in FIG. 1, there is an axial clearance between the plunger seal 48 and the plunger foot 45 when the plunger 12 is at the end of the return stroke.

The plunger seal 48 may be formed from a polymer such as PEEK or PTFE. Additionally, the polymer may contain additives, such as graphite or molybdenum disulphide, to reduce wear and friction.

A plurality of filling ports 50 are provided toward the downstream end of the inner pole piece 9. Each filling port 50 comprises a radial through bore, which extends from the axial bore 11 to the supply passage 14. The portion of the axial bore 11 which extends downstream from the filling ports 50 defines an outlet pumping chamber 52. Downstream from the outlet pumping chamber 52, an enlarged diameter portion of the axial bore 11 defines the pump outlet 6. The pump outlet 6 includes a one-way delivery valve 54. The delivery valve 54 is spring biased into a closed position, in which fluid communication between the pump outlet 6 and the outlet pumping chamber 52 is prevented.

With the above-described configuration, a fixed volume shot of fluid can be expelled via the delivery valve 54 for every stroke of the plunger 12. The frequency of the reciprocation of the plunger 12 determines the dosing flow rate.

The operation of the dosing pumping 1 will now be described in more detail. FIG. 1 shows the position of the pumping plunger 12 at the end of its return stroke. In this position, both the one-way inlet valve 24 and the delivery valve 54 are in their respective closed positions. Accordingly, reagent supplied to the pump inlet 3 may flow through the reagent filter 25, which serves to filter solid particles such as precipitates out of the reagent flow. However, reagent is prevented from entering the inlet pumping chamber 30 while the one-way inlet valve 24 remains closed.

In the case that the dosing pump 1 has not previously been used to pump reagent, the internal volume of the dosing pump 1 will initially be full of air. The internal volume of the dosing pump 1 comprises the inlet pumping chamber 30, the region surrounding the armature 40, the supply passage 14 and the filling ports 50.

In order to dispense reagent, a current is passed through the solenoid coil 8 to energise the coil 8 and induce a magnetic field around the coil 8. The resulting magnetic field exerts a force on the armature 40 which, in turn, drives a pumping stroke of the plunger 12.

As the plunger 12 moves in the downstream direction, the axial clearance between the plunger foot 45 and the plunger seal 48 closes and the plunger foot 45 biases the plunger seal 48 in the downstream direction. Accordingly, the volume of the inlet pumping chamber 30 disposed downstream of the plunger seal 48 decreases, thereby raising the fluid pressure in the internal volume of the dosing pump 1.

At the same time, the pressure in the volume of the inlet pumping chamber 30 upstream of the plunger seal 48 decreases. The reduction in pressure on the downstream side of the one way inlet valve 24 causes the flap 28 to lift. Accordingly, with the one-way inlet valve 24 now open, reagent is free to flow from the pump inlet 3 into the upstream portion of the inlet pumping chamber 30.

As the upstream end of the plunger 12 covers the filling ports 50, the fluid volume disposed in the outlet pumping chamber 52 is compressed and, accordingly, the fluid pressure in the outlet pumping chamber 52 increases until it is sufficient to overcome the closing force of the delivery valve 54, thereby causing the delivery valve 54 to open. When the delivery valve 54 opens, a fixed volume shot of fluid is expelled into the pump outlet 6 from where it is conveyed via the connecting pipe 4 to a nozzle dispenser (not shown) mounted in the exhaust gas stream of an engine.

When the plunger 12 reaches the end of its pumping stroke, such that the fluid volume in the outlet pumping chamber 52 is no longer compressed, the delivery valve 54 closes. When the current flow through the coil 8 is switched off, the magnetic field around the coil 8 diminishes. The magnetic force acting on the plunger 12, by way of the armature 40, diminishes and the plunger return spring 46 biases the plunger 12 in the upstream direction.

As the plunger starts 12 to move in the upstream direction, the plunger seal 48 remains stationary until the plunger 12 has travelled an axial distance equal to the axial distance between the clip 47 and the plunger seal 48. Thereafter, the clip 47 biases the plunger seal 48 in the upstream direction as the plunger 12 continues its return stroke. Accordingly, during the return stroke of the plunger 12, the axial clearance between the plunger foot 45 and the plunger seal 48 re-opens. At the same time, the flap 28 of the one-way inlet valve 24 is moved into its closed position due to the increased pressure in the inlet pumping chamber 30 upstream of the plunger seal 48 caused by the upstream movement of the plunger seal 48. The reagent which flowed into the upstream portion of the inlet pumping chamber 30 during the pumping stroke is forced through the axial clearance between the plunger foot 45 and the plunger seal 48 as the plunger 12 moves in the upstream direction.

The outer diameter of the plunger seal 48, which is substantially the same as the diameter of the inlet pumping chamber 30, is greater than the diameter of the upstream end of the plunger 12, which is substantially the same as the diameter of the outlet pumping chamber 52. Accordingly, in this first mode of operation of the pump, for a given axial displacement of the plunger 12 during a single pumping stroke the volume of fluid sucked into the inlet pumping chamber 30 through the one-way inlet valve 24 is greater than the volume of fluid expelled from the outlet pumping chamber 52 through the delivery valve 54. As a result of these different volumetric capacities, each pumping and return stroke of the plunger 12 causes a net increase in the fluid pressure within the internal volume of the pump 1.

As stated previously, in the case that the internal volume of the pump is initially full of air, repeated actuation of the plunger 12 causes the internal volume to fill with reagent as the air is expelled through the delivery valve 54. When sufficient air has been expelled, subsequent actuation of the plunger 12 causes liquid reagent to be expelled from the delivery valve 54. Additionally, continued actuation of the plunger 12 causes the fluid pressure of the reagent in the internal volume of the pump to continue to rise up to a threshold value, which is determined by the pressure regulating means 16.

The regulation of the fluid pressure within the internal volume of the pump will now be explained in more detail.

Referring to FIG. 3, when the fluid pressure within the internal volume of the pump reaches a desired level, the one-way inlet valve 24, seal washer 23 and rigid washer 22 are lifted away from the regulator seats 34, 35 against the action of the pressure regulating spring 21. This opens the upstream end of the bypass passage 32, which allows fluid to reciprocate freely between the portion of the inlet pumping chamber 30 that is upstream of the plunger seal 48 and the remainder of the internal volume of the pump.

During a pumping stroke of the plunger 12, the volume of the upstream portion of the inlet pumping chamber 30 increases, so it is at a lower pressure than the rest of the internal volume of the pump. Accordingly, with the pressure regulating means 16 in the open position, reagent can flow through the bypass passage 32 into the upstream portion of the inlet pumping chamber 30. The inflow of reagent into the upstream portion of the inlet pumping chamber 30 prevents one-way inlet valve 24 from opening, because the fluid pressure on the downstream side of the inlet valve 24 is not reduced enough for the flap 28 to lift. Thus, in this second mode of operation of the pump, for the part of the pumping stroke where the pressure regulating means 16 is open, no reagent is sucked in from the pump inlet 3. By reducing the amount of reagent which is pumped into the internal volume of the pump from the pump inlet 3, the fluid pressure in the internal volume of the pump can be maintained at the desired level.

The above-described pressure regulating means 16 has a number of advantages.

When equilibrium pressure is reached within the internal pump volume, the pressure regulating means 16 lifts off the regulator seats 34, 35 during the initial movement of the plunger 12 during a pumping stroke and closes again towards the end of the pumping stroke. The pressure regulating means 16 closes near the end of the pumping stroke because the pressure within the internal volume of the pump reduces as reagent is expelled through the delivery valve 54. As a result of this, parasitic forces only appear on the pumping plunger 12 when the plunger 12 is moving fast and when the solenoid has maximum force available. These pumping forces can be used to help decelerate the plunger 12 at the end of stroke and minimise the noise generated by the armature 40 reaching its end stop.

Another advantage provided by the pressure regulating means 16 is that when the system (i.e. the internal combustion engine to which the dosing pump 1 is attached) is switched off, if the heat soak from the exhaust system causes higher than normal temperatures and pressures within the dosing pump 1, the pressure regulating means 16 will lift to accommodate the expansion of the fluid, but will not allow the fluid to boil out through the inlet 3 of the pump 1. Therefore, the pump 1 always stays full of fluid. The fact that the pump 1 remains full of fluid between uses means that reagent can be dosed from engine start, without the need to wait for the dosing pump 1 to be primed with reagent.

Referring to FIG. 3, venting means 56 may be provided in order to protect the pump 1 in the case of extreme over-temperatures. The venting means 56 comprises a recess formed in the wall of the cavity 15 adjacent to the pressure regulating means 16 and provides a path for reagent to flow back to the pump inlet 3 when the pressure regulating means 16 lifts by more than a predetermined amount.

The above-described dosing pump also has a number of other advantages over known dosing pumps.

The axial clearance between the plunger seal 48 and the plunger foot 45, which is open immediately prior to each pumping stroke of the plunger 12, allows the plunger 12 to accelerate before the pumping load starts thereby minimising the effect of the additional pumping force on the plunger movement. This is particularly useful where the actuator is a solenoid actuator, due to the fact that the force on the armature 40 generated by the solenoid coil 8 is lower when at the start of the pumping stroke, i.e. when the armature 40 is at its greatest distance from the pole element 5.

The design of the dosing pump 1 allows for a reduction of noise at the end of the return stroke of the plunger 12. More specifically, during the return stroke of the plunger 12, any reagent in the portion of the inlet pumping chamber 30 disposed upstream of the plunger seal 48 is forced through the gap between the plunger 12 and the plunger seal 48 as the plunger 12 moves through the inlet pumping chamber 30. Accordingly, the axial clearance between the plunger seal 48 and the plunger foot 45 and the radial clearance between the inner diameter of the plunger seal 48 and the plunger body 12 may be tailored to provide fluid damping to limit the plunger 12 return velocity. Furthermore, the seal washer 23 and the pressure regulating spring 21 provide a soft buffer for the plunger foot 45 at the end of the return stroke.

As mentioned above, the fact that the dosing pump 1 remains full of reagent in-between uses means that priming of the pump is not usually required. However, in cases where the dosing pump 1 has not previously been used to pump reagent or has been emptied of reagent, for example during maintenance of the dosing pump 1, priming is still necessary before reagent dosing can take place. However, with a dosing pump 1 having the above-described configuration, the volume of fluid sucked into the inlet pumping chamber 30 during each pumping stroke of the plunger 12 is regulated in an efficient way. Accordingly, the dosing pump 1 can be designed with excess pumping capacity to speed up priming of the system when it is initially full of air.

For example, the inlet pumping chamber 30 may be sized such that the volume of fluid sucked through the one-way inlet valve 24 during a pumping stroke is three times the volume of fluid expelled through the delivery valve 54 during the same stroke. Accordingly, with the pressure regulating means 16 set to lift at 3 bar absolute pressure, three times the volume of air at atmospheric pressure is pumped into the internal volume of the pump 1 than the action of pumping fluid out of the outlet pumping chamber 52 would suck in on its own. As the air is then compressed by this factor of three by the movement of the plunger seal 48 within the inlet pumping chamber 30 (assuming isothermal compression), the dosing pump 1 is then able to deliver all of this air to the nozzle via the outlet pumping chamber 52.

Another advantage is provided by the fact that the plunger return spring 46 and plunger return spring seat 31 are disposed on the upstream side of the armature 40, rather than there being a spring chamber formed within the inner pole piece 9. The result is that the armature 40 is located directly upstream from the axial bore 11 of the inner pole piece 9. This improves guidance of the armature 40 and reduces the frictional effect of magnetic side loads that are caused by the eccentricity of the armature 40. Furthermore, with this arrangement, the compressibility of the fluid within a spring chamber is no longer an issue, which makes it easier to tailor the squeeze film damping forces on the armature 40 to decelerate it near the end of the pumping stroke. The use of soft buffers, as used at the end of the return stroke of the plunger 12, are not easily applicable here as variation in the compression of any buffer at the end of the pumping stroke would change the volume of fluid pumped.

In an alternative embodiment of the present invention (not shown), the plunger seal 48 may be attached to the end of the plunger 12 such that there is no axial clearance between the plunger seal 48 and the plunger foot 45. In this case, the plunger seal 48 is in contact with the plunger foot 45 throughout the whole of the pumping and return strokes. In order for such an embodiment to function, the force generated by the plunger return spring 46 must be sufficient so as to cause the pressure regulating means 16 to lift from the regulator seats 34, 35 during the return stroke of the plunger 12. Accordingly, fluid which has been sucked into the inlet pumping chamber 30 through the one-way inlet valve 24 during the pumping stroke is forced along the bypass passage 32 in the downstream direction during the return stroke. This configuration may be desirable if a really soft end of return stroke is required, i.e. to minimise noise during operation of the dosing pump 1.

Although the above-described embodiments of the present invention include only a single bypass passage 32, the pumping chamber element 17 may include more than one bypass passage, so the fluid forces on the pressure regulating spring 21 are symmetrical. For example, the pumping chamber element 17 may be provided with three bypass passages 32, which may be radially spaced at regular intervals around the pumping chamber element 17.

It will be appreciated that several other modifications and variations of the described embodiments are possible within the scope of the invention, as defined in the appended claims. For example, a pump could be provided with pumping means at the inlet and outlet that differ from the arrangements described above. It is also conceivable that a pump according to the invention could be provided having two separate actuator arrangements to operate pumping means at the inlet and outlet respectively.

The invention claimed is:

1. A pump for pumping a fluid, the pump comprising:

an inlet;

an outlet;

an internal volume disposed between said inlet and said outlet;

a first pumping arrangement operable to pump a first volume of fluid from the inlet into the internal volume, the first pumping arrangement elevating the pressure of the fluid to a level above the pressure of the fluid at the inlet; and a second pumping arrangement operable to pump a second volume of fluid from the internal volume into the outlet, the second pumping arrangement elevating the pressure of the fluid to a level above that of the first pumping arrangement;

wherein, in a first mode of operation of the pump, the first volume of fluid is greater than the second volume of fluid such that, in use, the pressure of the fluid within the internal volume is elevated to a level above the pressure of the fluid at the inlet.

2. A pump according to claim 1, wherein the first pumping arrangement comprises an inlet pumping chamber for receiving fluid from the inlet; and wherein the second pumping arrangement comprises an outlet pumping chamber from which fluid is pumped to the outlet; the inlet pumping chamber and the outlet pumping chamber each defining a respective part of the internal volume.

3. A pump according to claim 2, further comprising an actuator arrangement operable to move between a first position and a second position so as to operate both the first pumping arrangement and the second pumping arrangement.

4. A pump according to claim 3, comprising a plunger arranged to move in response to operation of the actuator arrangement, the plunger comprising:

an upstream end being arranged so as to be reciprocable within the inlet pumping chamber; and a downstream end being arranged so as to reduce the volume of the outlet pumping chamber when the actuator arrangement moves from the first to the second position.

5. A pump according to claim 4, wherein the plunger comprises an annular plunger seal disposed at the upstream end thereof, the plunger seal having an outer diameter which is sized so as to be an interference fit with an adjacent wall of the inlet pumping chamber, in order to prevent fluid communication between a portion of the inlet pumping chamber disposed upstream of the plunger seal and a portion of the inlet pumping chamber disposed downstream of the plunger seal during a pumping stroke of the plunger;

and wherein the volume of said downstream portion of the inlet pumping chamber is reduced when the actuator arrangement moves from the first to the second position.

6. A pump according to claim 4, wherein the plunger comprises:

an enlarged diameter portion at the upstream end thereof which defines a plunger foot, the plunger foot being sized so as to be a clearance fit with an adjacent wall of the inlet pumping chamber; and a retainer attached to the plunger and spaced from the plunger foot in the downstream direction, the retainer comprising at least a portion which extends radially from the plunger towards an adjacent wall of the inlet pumping chamber;

wherein said plunger seal is disposed between the plunger foot and the retainer.

7. A pump according to claim 6, wherein the retainer is spaced from the plunger foot by an axial distance greater than the axial thickness of the plunger seal, and wherein the plunger seal has an inner diameter which is sized so as to be a clearance fit with the plunger, but which is less than the diameter of the plunger foot and the distance by which the retainer extends radially towards the adjacent wall of the inlet pumping chamber.

8. A pump according to claim 2, further comprising:

a pressure regulator for regulating the pressure of the fluid within the internal volume of the pump at a predetermined value.

9. A pump according to claim 8, wherein the pressure regulator is operable, in a second mode of operation of the pump, to reduce the first volume of fluid pumped from the inlet when said fluid pressure within the internal volume of the pump exceeds the predetermined value.

10. A pump according to claim 9, wherein the pressure regulator is operable between an open and a closed position, the pressure regulator comprising a biasing arrangement for biasing the pressure regulator into said closed position;

and wherein the pressure regulator is operable to move into said open position, against the biasing force of the biasing arrangement, when said fluid pressure within the internal volume of the pump exceeds the predetermined value, so as to reduce the first volume of fluid pumped from the inlet.

11. A pump according to claim 10, wherein the pressure regulator comprises:

a bypass passage for providing fluid communication between an upstream portion of the inlet pumping chamber and a downstream portion of the inlet pumping chamber, so as to reduce the first volume of fluid pumped from the inlet by the first pumping arrangement; and a closure member arranged so as to prevent the flow of fluid through said bypass passage when the pressure regulator is in said closed position.

12. A pump according to claim 11, comprising an inlet valve operable between a closed position and an open position and arranged to prevent the flow of fluid from the inlet to the internal volume when the inlet valve is in the closed position; and wherein said closure member comprises the inlet valve and/or at least one washer.

13. A pump according to claim 8, wherein said pressure regulator further comprises a vent for venting fluid to the inlet in the event that the fluid pressure in the internal volume exceeds said predetermined value.

14. A pump according to claim 1, comprising an inlet valve operable between a closed position and an open position and arranged to prevent the flow of fluid from the inlet to the internal volume when the inlet valve is in the closed position.

15. A pump according to claim 1, comprising a delivery valve operable between a closed position and an open position and arranged to restrict the flow of fluid from the internal volume to the outlet when the delivery valve is in the closed position.

16. A pump according to claim 1, wherein the fluid is a liquid reagent for selective catalytic reduction.

17. A pump for pumping a fluid, the pump comprising:

an inlet;

an outlet;

an internal volume disposed between said inlet and said outlet;

a first pumping arrangement operable to pump a first volume of fluid from the inlet into the internal volume, the first pumping arrangement elevating the pressure of the fluid to a level above the pressure of the fluid at the inlet;

a second pumping arrangement operable to pump a second volume of fluid from the internal volume into the outlet, the second pumping arrangement elevating the pressure of the fluid to a level above that of the first pumping arrangement; and an actuator arrangement operable to move between a first position and a second position so as to operate both the first pumping arrangement and the second pumping arrangement.

18. A pump according to claim 17, further comprising:

a pressure regulator for regulating the pressure of the fluid within the internal volume of the pump at a predetermined value.

19. A pump according to claim 17 wherein, in a first mode of operation of the pump, the first volume of fluid is greater than the second volume of fluid such that, in use, the pressure of the fluid within the internal volume is elevated to a level above the pressure of the fluid at the inlet.

20. A pump for pumping a fluid, the pump comprising:

an inlet;

an outlet;

an internal volume disposed between said inlet and said outlet;

a first pumping arrangement operable to pump a first volume of fluid from the inlet into the internal volume, the first pumping arrangement elevating the pressure of the fluid to a level above the pressure of the fluid at the inlet; and a second pumping arrangement operable to pump a second volume of fluid from the internal volume into the outlet, the second pumping arrangement elevating the pressure of the fluid to a level above that of the first pumping arrangement; and a pressure regulator for regulating the pressure of the fluid within the internal volume of the pump at a predetermined value;

wherein, in a first mode of operation of the pump, the first volume of fluid is greater than the second volume of fluid such that, in use, the pressure of the fluid within the internal volume is elevated to a level above the pressure of the fluid at the inlet;

and wherein, in a second mode of operation of the pump, the pressure regulator is operable to reduce the first volume of fluid pumped from the inlet when said fluid pressure within the internal volume of the pump exceeds the predetermined value.

* * * * *